US007363093B2

(12) United States Patent
King et al.

(10) Patent No.: US 7,363,093 B2
(45) Date of Patent: Apr. 22, 2008

(54) CONTROL SYSTEM FOR A MULTI-COMPARTMENT DISHWASHER

(75) Inventors: Jonathan D. King, Cedar Grove, TN (US); Dean A. Werthman, Jackson, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 66 days.

(21) Appl. No.: 11/288,289

(22) Filed: Nov. 29, 2005

(65) Prior Publication Data

US 2007/0124004 A1 May 31, 2007

(51) Int. Cl.
*G05B 19/18* (2006.01)

(52) U.S. Cl. ..... 700/3

(58) Field of Classification Search ..... 700/3
See application file for complete search history.

(56) References Cited

U.S. PATENT DOCUMENTS 3,737,862 A * 6/1973 Reich ..... 340/3.21
4,245,319 A 1/1981 Hedges
4,336,462 A 6/1982 Hedges et al.
5,470,142 A 11/1995 Sargeant et al.
5,600,310 A 2/1997 Whipple, III et al.
5,760,493 A 6/1998 Outcalt et al.
5,839,097 A 11/1998 Klausner
6,294,767 B1 9/2001 Sargeant et al.
6,398,495 B1 6/2002 Kazianus
6,795,871 B2 * 9/2004 Nolan et al. ..... 710/8
2003/0007503 A1 * 1/2003 Daum et al. ..... 370/465
2003/0084928 A1 * 5/2003 Wood ..... 134/58 D
2004/0046454 A1 3/2004 Kang

* cited by examiner

*Primary Examiner*—Thomas K Pham
(74) *Attorney, Agent, or Firm*—Michael D. Lafrenz; John Morrison

(57) ABSTRACT

A multi-compartment dishwasher includes first and second washing units defining corresponding first and second washing tubs or chambers. The dishwasher also includes first and second control boards operatively associated with the first and second washing units respectively. Preferably, the first and second control boards are joined by a communication link that serves as a conduit for sharing data. The dishwasher further includes at least one ID designator that identifies one of the first and second washing units as a primary washing unit and the other of the first and second washing units as a secondary washing unit. The primary and secondary washing units share certain system resources during an overall washing operation, with the primary washing unit having preference over the secondary washing unit.

8 Claims, 3 Drawing Sheets

CONTROL SYSTEM FOR A MULTI-COMPARTMENT DISHWASHER

BACKGROUND OF THE INVENTION

1. Field of the Invention

The present invention pertains to the art of dishwashers and, more particularly, to a control system for a multi-compartment dishwasher.

2. Discussion of the Prior Art

In general, multi-compartment dishwashers are known in the art. Typically, a multi-compartment dishwasher includes multiple drawers or pull-out washing chambers slidably mounted in a cabinet. Of course there are also examples of multi-compartment dishwashers that combine a pull-out washing chamber with a conventional type compartment. Ordinarily, a dish rack is provided within each washing chamber to support dishware and the like during a washing operation. In most multi-compartment dishwashers, a washing operation can be performed in either one or both of the washing chambers.

Typically, household dishwashers are powered by a dedicated 15 amp circuit. When both compartments of a multi-compartment dishwasher are operating simultaneously, power must be shared between the washing chambers. Generally, power sharing between the washing chambers does not pose any problems. Wash pumps, drain pumps and control elements do not, in most cases, have high power requirements. In contrast, heating units for heating the washing fluid do have a high power requirement. Simultaneous operation of the heating units could cause the dishwasher to exceed the 15 amp circuit limit.

In order to ensure that a multi-compartment dishwasher doesn't exceed the 15 amp circuit limit, manufacturers employ a control system that staggers operation of the washing chambers. That is, the control system delays activating one of the washing chambers until another of the washing chambers reaches a predetermined point in the washing operation. Staggering operation of the chambers ensures that the heating units are not operated at the same time. However, in order to achieve and/or time the desired staggered operation, each washing chamber requires special programming and/or dedicated electrical circuitry.

In addition to sharing power, some multi-compartment dishwashers are designed to share a common water supply. That is, the dishwasher includes a single water inlet valve that is bifurcated to feed each washing chamber during simultaneous operation. The valve is operated to fill one, then the other of the washing chambers. Of course, sharing a single fill valve requires additional programming for the control system.

In general, when sharing resources between multiple washing chambers, one chamber must be dominant over the other. More specifically, one chamber must be designated as a primary chamber and the other as a secondary chamber. The primary chamber receives initial access to system resources, while the secondary chamber must wait for the system resources to be allocated. In order to achieve this hierarchical relationship, even more programming and additional extensive wiring/circuitry is necessary.

Based on the above, there still exists a need for a control system for a multi-compartment dishwasher that can designate one compartment as being primary and other compartment(s) as being secondary without requiring specific controllers, control programming or extensive wiring/circuitry. That is, there exists a need for a universal controller that can be externally assigned as a primary or secondary controller.

SUMMARY OF THE INVENTION

The present invention is directed to a multi-compartment dishwasher such as having first and second drawers slidably positioned in an outer housing. Each of the first and second drawers includes front, rear, bottom and opposing side walls that collectively define corresponding first and second washing tubs or chambers. In accordance with the invention, the dishwasher also includes first and second control boards that are operatively associated with the first and second washing chambers respectively.

In accordance with the most preferred form of the invention, the first and second control boards are joined by a communication link. The communication link serves as a conduit for sharing data between the control boards. The control boards are also linked to an ID designator that identifies one of the first and second washing tubs as a primary washing tub and the other of the first and second washing tubs as a secondary washing tub. Actually, only one of the control boards need be linked to the ID designator, with the other being designated by the lack of such a link. In any event, the ID designator establishes a hierarchical relationship that enables the primary and secondary washing tubs to share system resources during an overall washing operation. Preferably, the primary washing tub is initially allocated the system resources, while the secondary washing tub is in a delay or stand-by mode waiting for resources to be allocated. That is, the primary washing tub has preference over the secondary washing tub.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
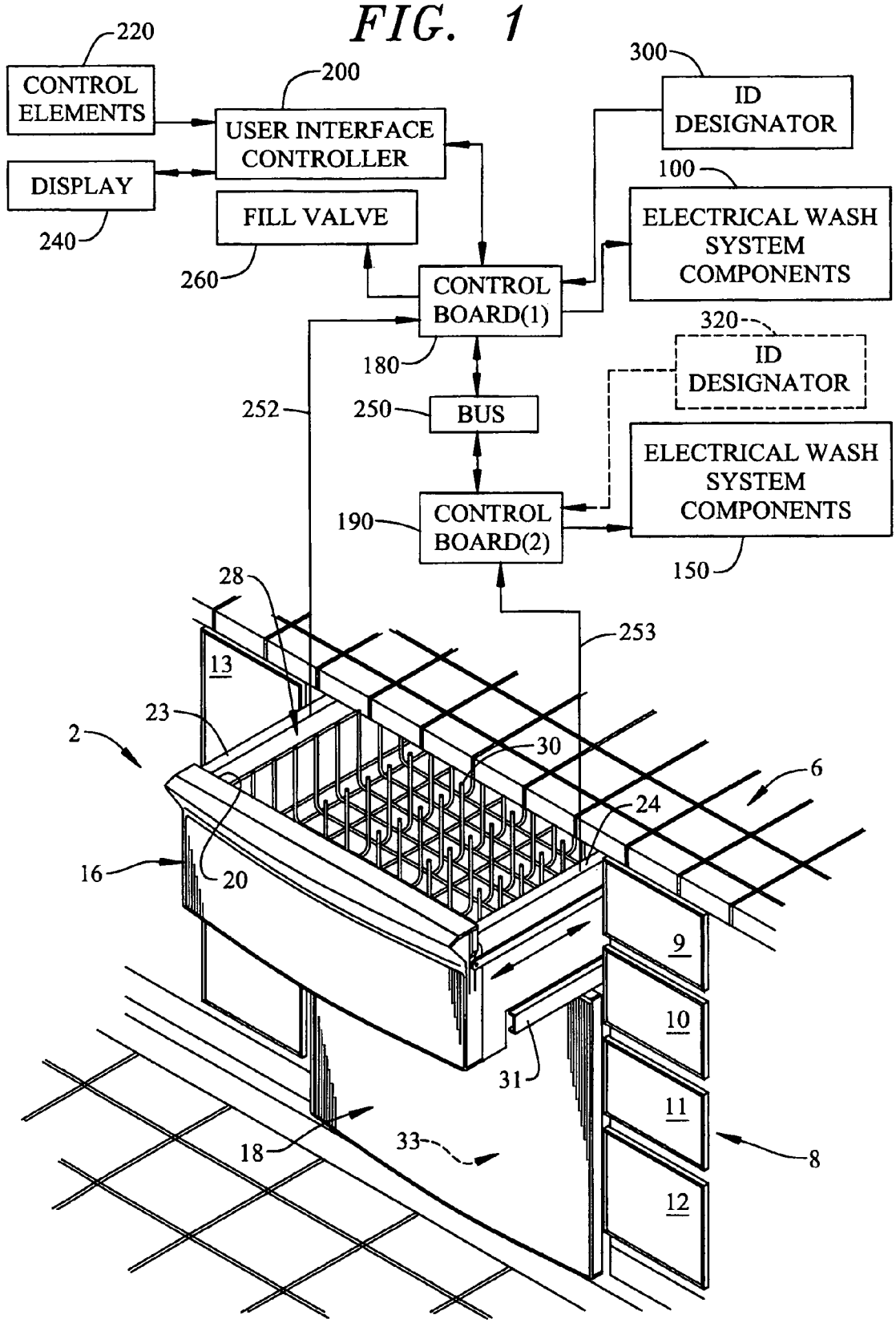
FIG. 1 is an upper right perspective view of a multi-compartment dishwasher incorporating a control system constructed in accordance with the present invention.
Figure 2:
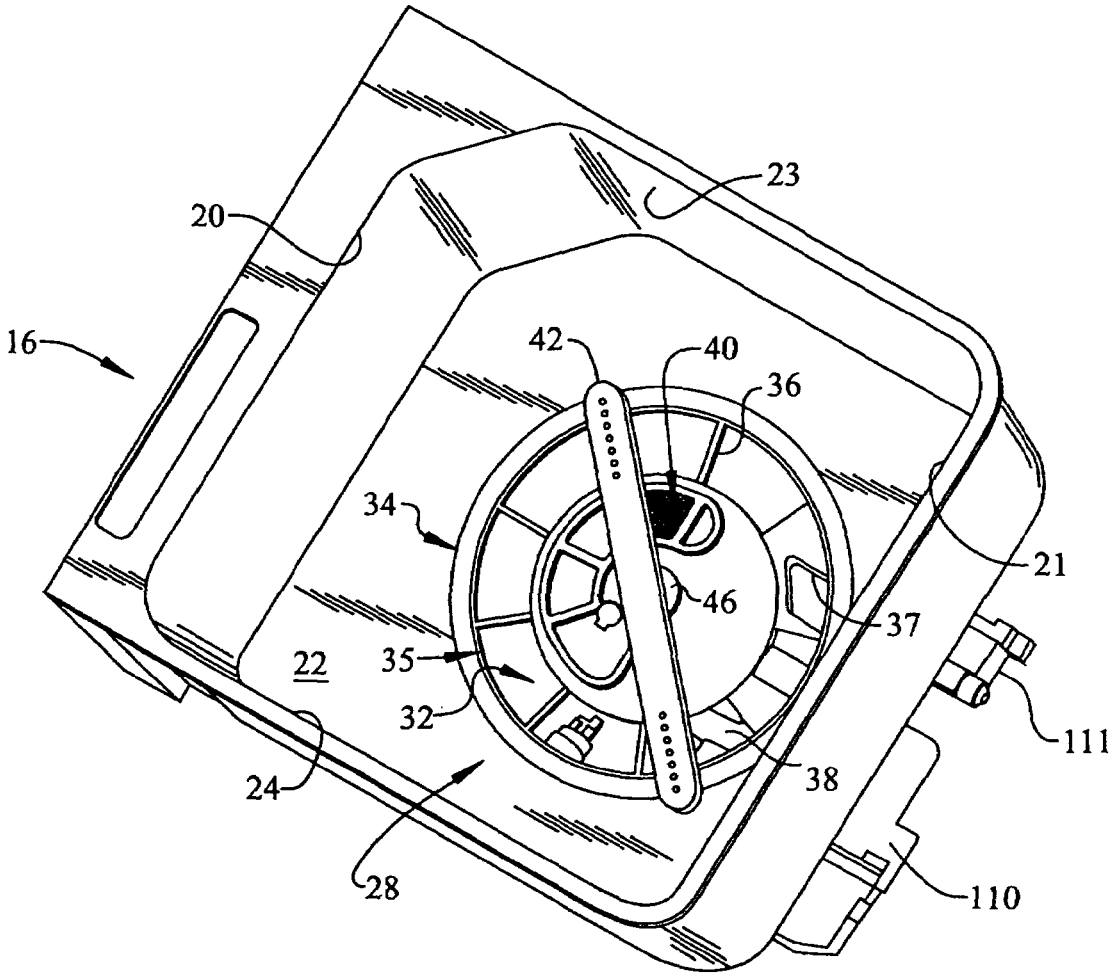
FIG. 2 is an upper perspective view of a washing tub of the dishwasher of FIG. 1.

With initial reference to FIGS. 1 and 2, a multi-compartment dishwasher constructed in accordance with the present invention is generally indicated at 2. Dishwasher 2 includes an outer housing (not shown) arranged below a kitchen countertop 6. Also below kitchen countertop 6 is shown cabinetry 8 including a plurality of drawers 9-12, as well as a cabinet door 13. Although the actual dishwasher into which the present invention may be incorporated can vary, the invention is shown in connection with dishwasher 2 depicted as a multi-compartment drawer-type dishwasher having an upper compartment 16 and a lower compartment 18. As best illustrated in FIG. 1, upper compartment 16 takes the form of a slide-out drawer unit having a small or medium capacity so as to be used for cleaning glassware and the like, while lower compartment 18 is illustrated as a larger capacity drawer for washing items such as dinnerware, cookware and other large sized objects. Of course, upper and lower compartments 16 and 18 could be of similar in size. Also, dishwasher 2 could include a combination single pull-out drawer unit and a conventional dishwashing unit.

Upper compartment 16 is shown to include a front wall 20, a rear wall 21, a bottom wall 22 and opposing side walls 23 and 24 that collectively define an upper washing unit or tub 28. Upper washing tub 28 is provided with a dish rack 30 for supporting various objects, such as glassware, utensils and the like, to be exposed to a washing operation. Upper compartment 16 is slidingly supported within the outer housing through a pair of extendible support guides, one of which is indicated at 31. In the embodiment shown, bottom wall 22 actually forms part of a sump 32 that, as will be discussed more fully below, manages a flow of washing fluid within upper compartment 16. Although not shown, lower compartment 18 similarly includes front, rear, bottom and opposing side walls that collectively define a lower washing unit or tub 33.

Figure 3:
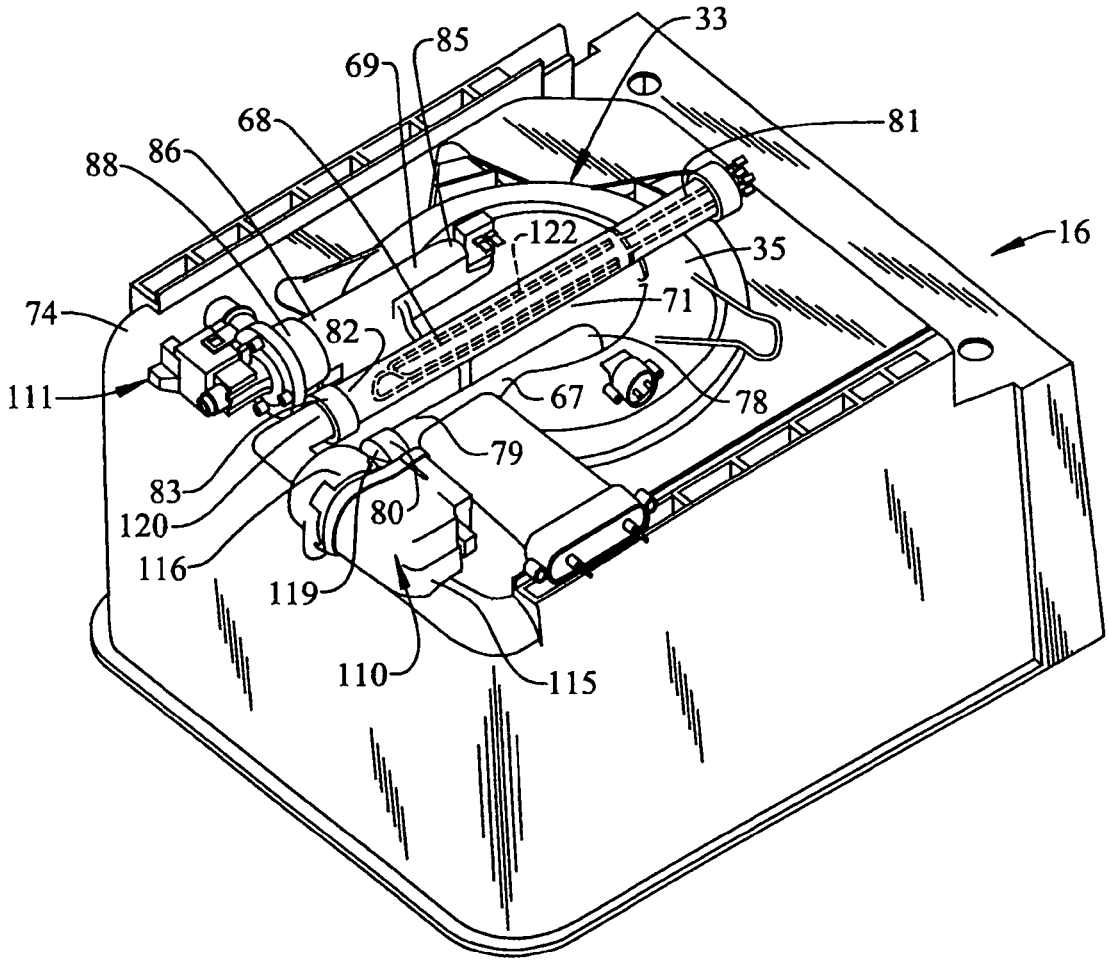
FIG. 3 is a lower perspective view of the washing tub of FIG. 2 illustrating a plurality of electrical wash system components.

As best shown in FIGS. 2 and 3, bottom wall 22 is provided with a recessed portion 34 having a generally U-shaped cross section that defines an intake ring 35. A coarse particle strainer 36 extends about recessed portion 34 to trap/prevent large soil particles from entering sump 32. Towards that end, coarse particle strainer 36 includes a plurality of openings, one of which is indicated at 37, provided with coarse filter screens (not shown) formed from, for example, a polyester mesh, plastic or stainless steel. The large soil particles trapped by coarse particle strainer 36 are ultimately collected in a coarse particle collection chamber 38, while other, smaller particles enter into sump 32 to ultimately collect in a fine particle collection chamber 40. Also shown in FIG. 2 is a wash arm 42 that is rotatably supported upon a hub 46. In a manner known in the art, wash arm 42 emits jets of water and/or washing fluid that are directed onto the various objects supported on dish rack 30.

Referring specifically to FIG. 3, sump 32 includes a plurality of fluid conduits 67-69 integrally formed along bottom wall 22 of washing tub 28. However, in an alternative arrangement, conduits 67-69 could be detachably secured to bottom wall 22. In any case, fluid conduit 67 constitutes a wash fluid supply conduit, fluid conduit 68 constitutes a wash fluid recirculation conduit and fluid conduit 69 constitutes a wash fluid drain conduit. Each of fluid conduits 67-69 provides wash fluid flow management during a washing operation. Preferably, fluid conduits 67-69 are spaced from and arranged substantially parallel to one another on bottom wall 22, with conduits 67 and 69 extending from a central portion 71 of intake ring 35 to an outer edge portion 74 of washing tub 28. More specifically, supply conduit 67 includes a first end 78 which is in fluid communication with wash arm 42 and leads to a second end 79 that is provided with an attachment flange 80. Likewise, recirculation conduit 68 extends from a first end 81, which extends beyond intake ring 35 towards a front portion of compartment 16, to a second end 82. In a manner similar to that described for supply conduit 67, recirculation conduit 68 is provided with a corresponding attachment flange 83. Finally, drain conduit 69 extends from a first end 85 to a second end 86 which is also provided with an associated attachment flange 88.

In addition to managing the flow of washing fluid in dishwasher 2, sump 32 serves as a mounting platform for a plurality of electrical wash system components which are generally represented at 100 in FIG. 1. As more specifically illustrated in FIGS. 2 and 3, electrical wash system components 100 include a wash pump 110 and a drain pump 111 that are shown connected to washing tub 28 along outer edge portion 74. Preferably, wash pump 110 includes a wash motor housing 115 and a wash pump housing 116. More preferably, wash pump housing 116 includes an outlet 119 and an inlet 120 that conducts washing fluid back from washing tub 28 to pump housing 116. In addition to wash pump 110 and drain pump 111, electrical wash system components 100 include a heater element 122 that is positioned within recirculation conduit 68. Heater element 122 is selectively activated to heat the washing fluid that is circulating into and out of washing tub 28 during a wash portion of the washing operation. Of course, lower washing tub 18 includes corresponding electrical wash system components as indicated at 150.

The above described structure has been provided for the sake of completeness and to enable a better understanding of the overall invention. Actually, a more detailed description can be found in commonly assigned U.S. patent application Ser. No. 11/052,862 filed on Feb. 9, 2005 which is incorporated herein by reference. Instead, the present invention is directed to a control system for dishwasher 2.

In accordance with the invention as shown in FIG. 1, dishwasher 2 includes a pair of control boards 180 and 190 that activate and manage the operation of electrical wash system components 100 and 150. More specifically, dishwasher 2 includes a first control board 180 operatively associated with washing operations in washing tub 28 and a second control board 190 operatively associated with washing operations in washing tub 33. Of course, it should be understood that control boards 180 and 190 could simply represent chips, or other forms of unit controllers. That is, based on inputs entered through a user interface controller 200, control boards 180 and 190 selectively activate wash system components 100 and 150 to establish washing operations in washing tubs 28 and 33 respectively. Therefore, a consumer can select, through a plurality of control elements 220, a desired wash cycle and cycle options to be performed in one, the other or both of washing tubs 28 and 32. In the embodiment shown, cycle and option selections, as well as wash/rinse cycle times remaining, are presented to the consumer on a display 240.

In further accordance with the invention, first and second control boards 180 and 190 are joined by a communication link or bus 250. In addition, first and second control boards 180 and 190 receive signals from various sensors, such as temperature, turbidity, and the like sensors (not shown) through lines 252 and 253, with the number and type of sensors being model dependent. Communication bus 250 can take the form of a multi-drop bus, a peer to peer connection, a wireless link, or a serial or parallel connection. In any case, communication bus 250 enables first and second control boards 180 and 190 to share and communicate, i.e., both receive event data and broadcast status information, with user input controller 200, along with sharing other resources such as a common fill valve 260. At this point, it should be noted that, although first and second washing tubs 28 and 33 preferably share access to fill valve 260, in order to ensure efficient operating conditions, fill valve 260 is preferably controlled to only fill one washing tub 28 or 32 at a time. In this manner, a maximum flow of water is introduced to fill a selected washing tub 28 or 33, thereby allowing the start of a desired washing operation to occur in a short time period. Once filled, the washing operation can commence and, if selected, the other of washing tubs 28 and 33 is filled. Likewise, first and second control boards 180 and 190 activate electric wash system components 100 and 150 in such a way so as to not overload a supply circuit. For instance, first and second control boards 180 and 190 preferably do not allow simultaneous activation of the heater elements 122 for washing tubs 28 and 33, at least in the case wherein activating heater elements 122 at the same time will exceed the current rating of the supply circuit. In any case, operation of shared resources is implemented through a control board hierarchy. That is, one of control boards 180 and 190 is designated as a master or primary control board, while the other of control boards 180 and 190 is designated as a slave or secondary control board as discussed more fully below. In other words, while each control board 180, 190 is directly connected to system components 100, 150 respectively, the control board 180, 190 designated as the slave, for example control board 190 cannot activate one or more wash system components 150, e.g. respective heater element 122, if control board 180 has already activated other wash system components 100. Likewise, control board 190 could not activate fill valve 260 if control board 180 has already initiated a fill in washing tub 28.

In accordance with the most preferred form of the invention, dishwasher 2 includes first and second ID designators 300 and 320 that establish the hierarchy between first and second control boards 180 and 190 and, ultimately, first and second washing tubs 28 and 33. Preferably, first and second ID designators 300 and 320 are arranged external to control boards 180 and 190, thus allowing the use of universal or identical control boards 180 and 190. That is, control boards 180 and 190 are substantially identical to one another in all respects, while a hierarchy is established between boards 180 and 190 through ID designators 300 and 320. Most preferably, ID designators 300 and 320 take the form of zero ohm jumpers, resistors of a known value, diodes or other like elements arranged in control circuitry. For example, in the case of a zero ohm jumper, the simply presence or absence of the jumper can establish the hierarchy. In other cases, the specific value or other attribute of the particular ID designator 300, 320 will determine which control board 180, 190 is dominant. Although two designators are described, a single designator could be employed as exemplified by the dotted lines in FIG. 1. Also, while shown linked directly to control boards 180, 190, ID designators 300 and 320 could be connected in other ways, such as through bus 250.

Once the hierarchy is established, the primary or dominant control board, for example, control board 180, is provided with preferential access to system resources. In other words, if both washing tubs 28 and 33 are active, the primary control board 180 will signal fill valve 260 to first introduce water into the primary washing tub 28. The primary washing tub 28 will also be provide with preferential access to system resources, such as the respective heating element 122. In this manner, the present invention advantageously allows the use of common or universal control boards 180 and 190 while still enabling a hierarchy to be readily established between compartments of a multi-compartment dishwasher. In addition, it should be realized that the invention advantageously allows multiple, individual dishwasher units or modules to be constructed, with the modules being useable alone or selectively interconnected to form an overall dishwasher 2 with a link established between control boards for each unit and one or more ID designators connected to the unit(s) to establish a preferred hierarchy.

Although described with reference to a preferred embodiment of the invention, it should be readily understood that various changes and/or modifications can be made to the invention without departing from the spirit thereof. For example, while the fill valve is shown connected to a control board, the valve could be connected to the bus and control of the valve established by any designated hierarchy. Also, while the present invention is described as having a single use interface, multiple user interfaces, i.e., a user interface for each washing tub, could also be employed. In general, the invention is only intended to be limited by the scope of the following claims.

We claim:

1. A dishwasher comprising:

at least one outer housing;

a first washing unit positioned in the at least one outer housing, said first unit including bottom, rear and opposing side walls that collectively define a first washing tub;

a second washing unit positioned in the at least one outer housing, said second unit including bottom, rear and opposing side walls that collectively define a second washing tub;

a first controller operatively associated with the first washing tub;

a second controller operatively associated with the second washing tub;

a communication link joining the first and second controllers; and user-configurable control circuitry for designating one of the first and second washing units as a primary washing unit and another of the first and second washing units as a secondary washing unit, said user-configurable control circuitry being external to, yet operatively associated with at least one of the first and second controllers, wherein the primary and secondary washing units share system resources during an overall washing operation with the primary washing unit having preference over the secondary washing unit.

2. The dishwasher according to claim 1, wherein the first and second controllers are substantially identical.

3. The dishwasher according to claim 2, wherein the first and second controllers are constituted by respective first and second control boards.

4. The dishwasher according to claim 1, wherein the first washing unit is constituted by a first drawer slidably supported in the at least one outer housing and the second washing unit is constituted by a second drawer slidably supported in the at least one outer housing.

5. A dishwasher comprising:

at least one outer housing;

a first washing unit positioned in the at least one outer housing, said first unit including bottom, rear and opposing side walls that collectively define a first washing tub;

a second washing unit positioned in the at least one outer housing, said second unit including bottom, rear and opposing side walls that collectively define a second washing tub;

a first controller operatively associated with the first washing tub;

a second controller operatively associated with the second washing tub, said second controller being substantially identical to the first controller;

a communication link joining the first and second controllers; and user-configurable control circuitry for designating one of the first and second washing units as a primary washing unit and another of the first and second washing units as a secondary washing unit, said user-configurable control circuitry being operatively associated with at least one of the first and second controllers, wherein the primary and secondary washing units share system resources during an overall washing operation with the primary washing unit having preference over the secondary washing unit.

6. The dishwasher according to claim 5, wherein the first and second controllers are constituted by respective first and second control boards.

7. The dishwasher according to claim 5, wherein the first washing unit is constituted by a first drawer slidably supported in the at least one outer housing and the second washing unit is constituted by a second drawer slidably supported in the at least one outer housing.

8. A method of controlling a dishwasher having a first drawer including a first set of wash system components and a second drawer including a second set of wash system components comprising:

connecting a first control board to the first set of wash system components;

connecting a second control board to the second set of wash system components;

establishing a communication link between the first and second control boards;

prior to the initiation of a wash cycle, designating one of the first and second control boards as a primary control board and another of the first and second control boards as a secondary control board using control circuitry, said control circuitry being user-configurable, and separate and distinct from each of the first and second control boards.

* * * * *